US009021625B1

(12) United States Patent
Vagner, Jr. et al.

(10) Patent No.: US 9,021,625 B1
(45) Date of Patent: May 5, 2015

(54) DOMED SWIMMING POOL COVER

(76) Inventors: Donald R. Vagner, Jr., Cleveland, OH (US); Lisa C. Graham, Cleveland, OH (US)

( * ) Notice: Subject to any disclaimer, the term of this patent is extended or adjusted under 35 U.S.C. 154(b) by 482 days.

(21) Appl. No.: 13/111,057

(22) Filed: May 19, 2011

(51) Int. Cl.
*E04H 4/00* (2006.01)
*E04H 4/10* (2006.01)

(52) U.S. Cl.
CPC ..... *E04H 4/10* (2013.01)

(58) Field of Classification Search
CPC ..... E04H 4/00
USPC ..... 4/498, 488, 499–502; 482/55
See application file for complete search history.

(56) References Cited

U.S. PATENT DOCUMENTS 3,475,768 A * 11/1969 Burton ..... 4/500
3,683,427 A * 8/1972 Burkholz et al. ..... 4/499
4,257,132 A * 3/1981 Kerby ..... 4/498
5,450,635 A * 9/1995 Coffey ..... 4/498
D388,180 S * 12/1997 Weihbrecht ..... D25/61
5,901,503 A * 5/1999 Dalene et al. ..... 52/2.11
6,272,695 B1 * 8/2001 Brandner ..... 4/498
6,381,767 B1 * 5/2002 Brashears ..... 4/498
6,442,773 B1 * 9/2002 Kopyar et al. ..... 4/498
6,487,734 B1 * 12/2002 First ..... 4/498
D571,481 S * 6/2008 Gray ..... D25/2
7,931,058 B2 * 4/2011 Cruz ..... 144/286.5
2007/0199142 A1 * 8/2007 Gray ..... 4/498
2010/0058529 A1 3/2010 Decker

* cited by examiner

*Primary Examiner* — Lori Baker
(74) *Attorney, Agent, or Firm* — Robert C. Montgomery; Montgomery Patent & Design

(57) ABSTRACT

A pool cover for above ground swimming pools includes a cover with an elevated central area, a plurality of rods to support the cover, and a plurality of clip assemblies to couple the rods to the swimming pool. The cover is a waterproof textile having a plurality of sleeve members allowing for insertion of the support rods to secure and support the cover. Each clip assembly includes hook which removably attaches to an upper perimeter edge of the pool and a pocket to receive an end of the support rod. When assembled, the support rods form a dome-like structure circularly arranged about the edge of the pool.

16 Claims, 10 Drawing Sheets

DOMED SWIMMING POOL COVER

RELATED APPLICATIONS

The present invention was first described in a notarized Official Record of Invention on Apr. 29, 2010, that is on file at the offices of Montgomery Patent and Design, LLC, the entire disclosures of which are incorporated herein by reference.

FIELD OF THE INVENTION

The present invention relates generally to pool covers, and in particular, to a domed swimming pool cover and support frame for above ground pools.

BACKGROUND OF THE INVENTION

Swimming pool owners who live in areas that require that they leave them covered during the winter months know all too well of the burdens and hassles associated with pool cover maintenance. Typically, these covers are anchored around the pool perimeter and supported in the pool itself by balloon-like floats. The floating supports tend to either deflate or move about resulting in sagging portions that collect leaves, branches and water. As a result, the pool owner must constantly adjust the cover, reposition and inflate the floats, and tighten the perimeter anchoring. Furthermore, the cover can become damaged and torn due to the excessive stress created by the collected water and debris. Ultimately, the cover needs to be replaced prematurely and at a considerable cost.

While there have been attempts to provide alternate pool covers for both in ground and above ground pools, each suffers from one or more disadvantage or deficiency related to design or utilization.

SUMMARY OF THE INVENTION

The inventor has therefore recognized the aforementioned inherent problems and lack in the art and observed that there is a need for a device for covering a pool that solves the problems associated with conventional float-type support pool covers. In accordance with the invention, it is an object of the present disclosure to solve these problems.

The inventor recognized these problems and has addressed this need by developing a domed swimming pool cover that allows pool owners to keep rain, snow, leaves, and other debris out of their swimming pool over the winter months in a manner which is quick, easy and efficient as well as long lasting and cost effective as well. The inventor has thus realized the advantages and benefits of providing the domed cover for above ground swimming pools which has a plurality of support rods having opposing ends spanning a diameter of the swimming pool. A cover assembly is supported by the plurality of support rods to cover the swimming pool. A plurality of clip assemblies is removably connected around an upper perimeter edge of the swimming pool. The opposing ends of the support rods are removably coupled between opposing pairs of clip assemblies.

In at least one (1) embodiment, a central portion of each of the plurality of support rods is elevated relative to the opposing ends and the clip assemblies mounted to the swimming pool upper perimeter edge.

In at least one (1) embodiment, the cover includes an anchoring strap to wrap around the side walls of swimming pool to secure the cover assembly to said sidewalls. The cover assembly has a plurality of strap loops disposed around a lower portion and the anchoring strap is routed through the plurality of strap loops.

In at least one (1) embodiment, the cover assembly further comprises a durable waterproof textile having shape and dimensions larger than said swimming pool to overlap said upper perimeter edge to prevent debris from entering said swimming pool.

In at least one (1) embodiment, the cover includes three (3) support rods and three (3) clip assemblies. A central portion of the support rods intersect and are elevated relative to the upper perimeter edge of the swimming pool.

In at least one (1) embodiment, the cover includes four (4) support rods and eight (8) clip assemblies. A central portion of the support rods intersect and are elevated relative to the upper perimeter edge of the swimming pool.

In at least one (1) embodiment, the cover includes five (5) support rods and ten (10) clip assemblies. A central portion of the support rods intersect and are elevated relative to the upper perimeter edge of the swimming pool.

Furthermore, the described features and advantages of the disclosure can be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
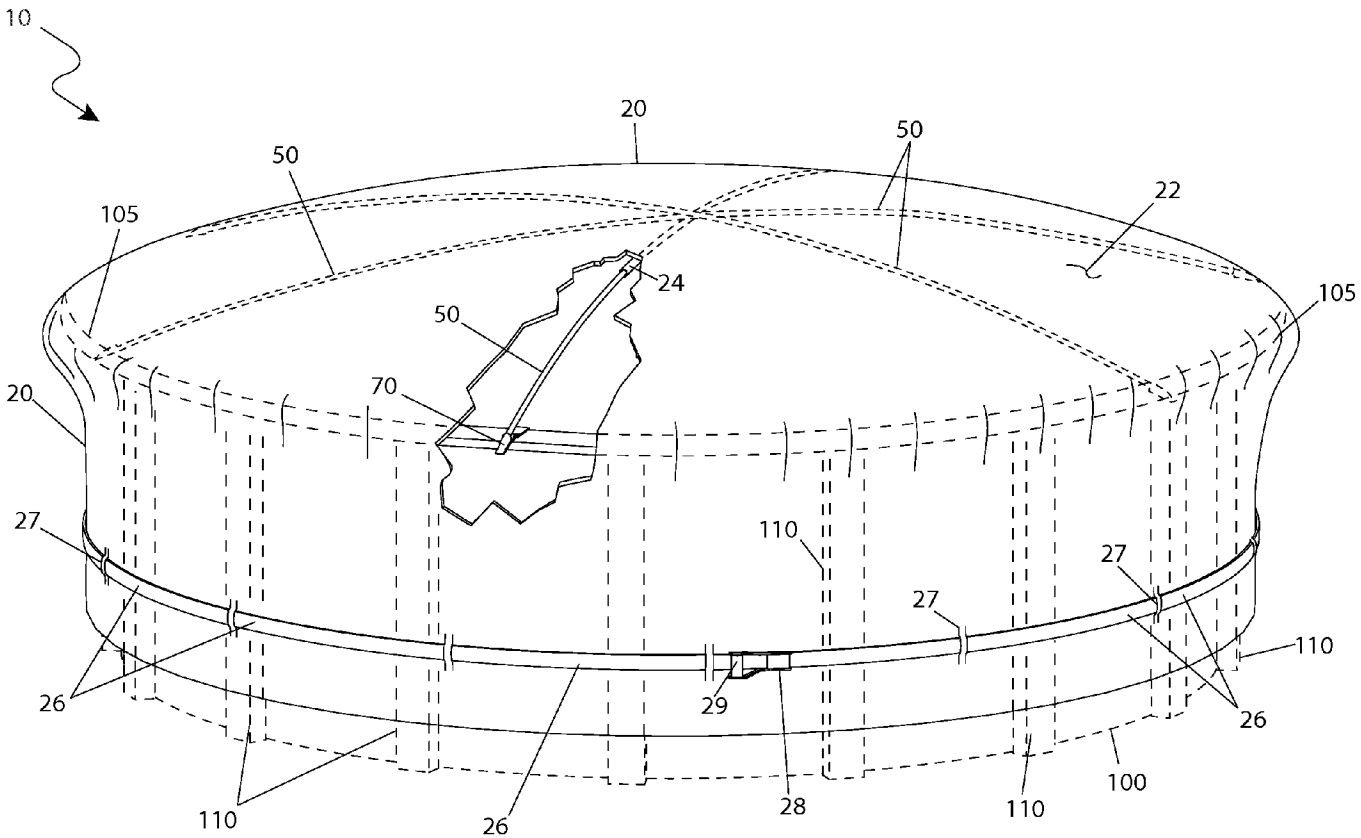
FIG. 1 is an environmental cut-away view of a domed swimming pool cover, according to a preferred embodiment in accordance with the invention.

10 domed swimming pool cover
20 cover assembly

22 top surface
23 bottom surface
24 sleeve
26 anchoring strap
27 strap loop
28 ratcheting device
29 handle
50 support rod
70 clip assembly
72 clip
74 aperture
76 hook feature
80 support rod strap
82 loop
85 stitching
86 pocket
100 above-ground pool
105 upper perimeter edge
110 vertical support
200 first alternate embodiment
220 first alternate cover assembly
224 first alternate sleeve
250 first alternate support rod
300 second alternate embodiment
320 second alternate cover assembly
324 second alternate sleeve
350 second alternate support rod

DETAILED DESCRIPTION OF THE PREFERRED EMBODIMENT

In accordance with the invention, the best mode is presented in terms of a preferred embodiment, herein depicted within FIGS. 1, 2*a*, 2*b*, 3, 4*a*, and 5 and in terms of alternate embodiments, herein depicted within FIGS. 2*c*, 2*d*, 4*b*, and 4*c*. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 5, depicting a domed swimming pool cover (herein described as an "apparatus") 10, where like reference numerals represent similar or like parts. In accordance with the invention, the present disclosure describes an elevated pool cover for above-ground swimming pools 100.

FIG. 1 shows an environmental cut-away view the apparatus 10. The apparatus 10 includes a cover assembly 20, a plurality of support rods 50, and a plurality of attaching clip assemblies 70. The apparatus 10 also includes a flexible domed cover 20 supported by preferably three (3) fiberglass rods 50 similar to a camping tent support structure (see FIG. 3). The cover assembly 20 is a waterproof textile assembly having an overall diameter which exceeds a diameter of the swimming pool 100, so as to suitably drape partway down the side walls of the swimming pool 100.

The cover assembly 20 extends over an upper perimeter edge and downward over the side walls of the swimming pool 100 and secured by an anchoring strap 26 arranged circumferentially around a bottom edge of the cover assembly 20 and lower end portion of the side walls. The anchoring strap 26 is routed through and supported by a plurality of equally-spaced strap loops 27 formed within the cover assembly 20. The anchoring strap 26 is positioned adjacent to a bottom perimeter edge of the cover assembly 20 to provide a tighten circumferentially around the pool 100 by an in-line ratcheting device 28 which cinches opposing ends of the strap 26 and tightens by repeated motioning of a handle 29 of the ratcheting device 28 in a conventional manner to secure the cover assembly 20 around the swimming pool 100. Each loop 27 includes a pair of vertical slits in the textile cover assembly 20 approximately two (2) inches apart, through which the anchor strap 26 is routed. Preferably the cover assembly 20 includes various decorative colors and patterns.

In an assembled state, the apparatus 10 allows rain water to run off of edge portions of an top surface 22 of the cover assembly 20 as well as keep leaves, twigs and other debris from collecting on the top surface 22. Use of the apparatus 10 allows a pool owner to keep rain, snow, leaves, and other debris out of their swimming pool 100 during winter months in a manner which is quick, easy, and effective.

Figure 2A:
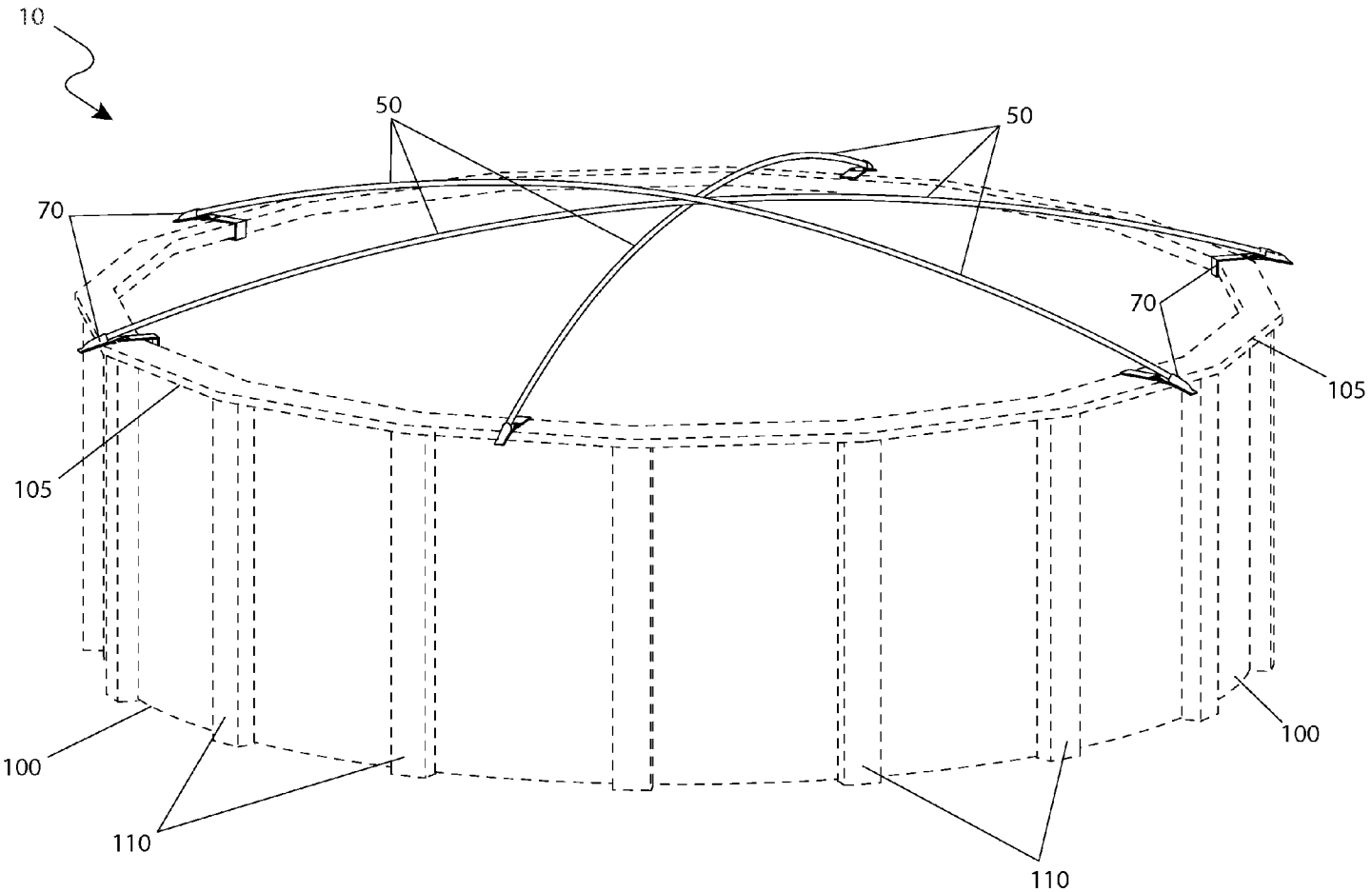
FIG. 2*a* is a perspective view of a plurality of support rods depicted as attached to a swimming pool, according to the preferred embodiment.
Figure 2B:
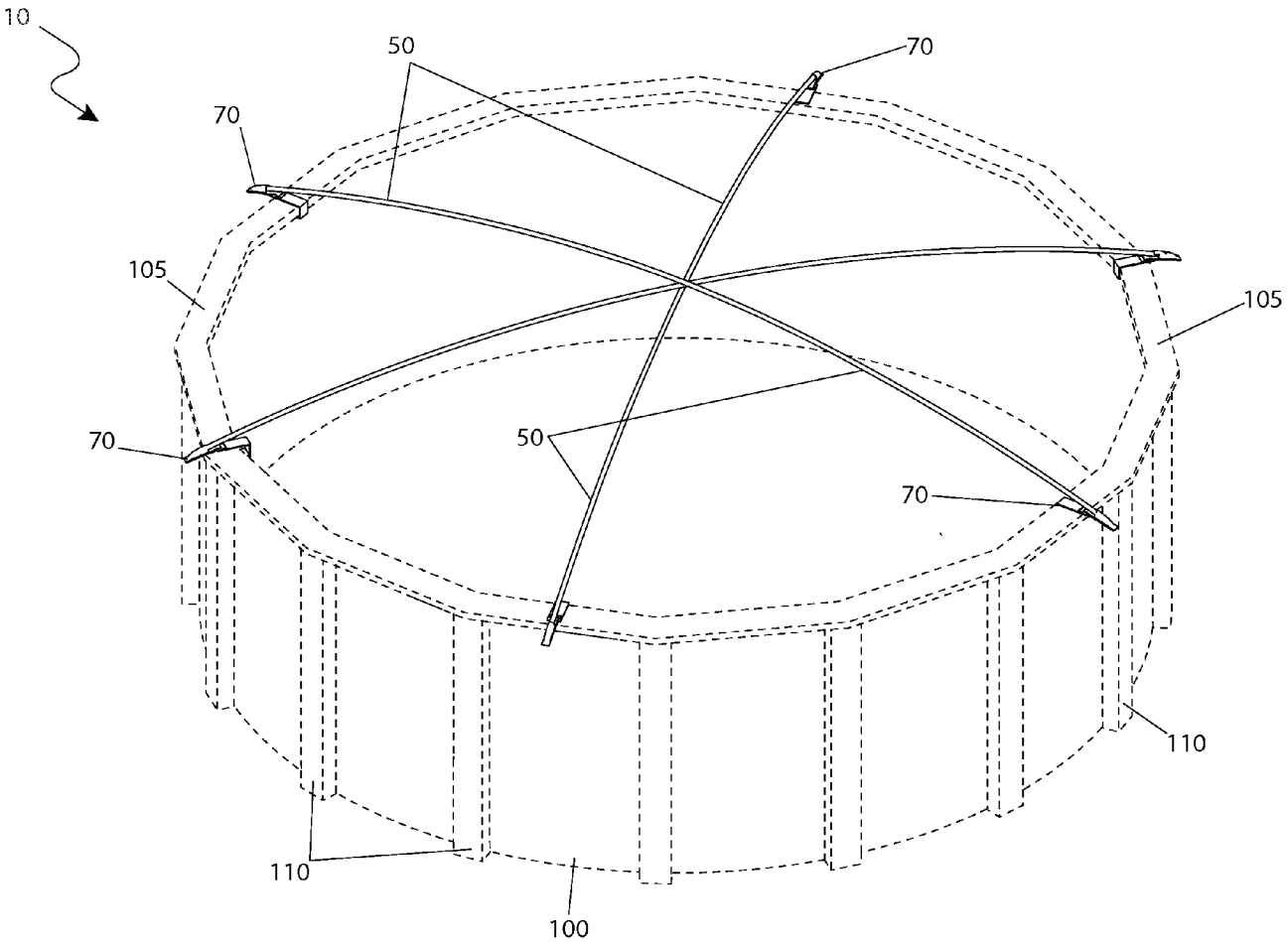
FIG. 2*b* is a top perspective view of the plurality of support rods depicted as attached to the swimming pool, according to the preferred embodiment.

FIGS. 2*a* and 2*b* show the support rods 50 of the apparatus 10 as attached to the perimeter edge 105 of the pool 100. Each of the plurality of reinforced fiberglass support rods 50 are approximately one-half (½) to one (1) inch in diameter and engage and support the cover assembly 20. The support rods 50 are inserted into narrow sewn-in sleeves 24 on the bottom surface 23 of the cover assembly 20 (see FIGS. 1 and 4*a*). The support rods 50 extend across opposing points along the upper perimeter edge 105 of the swimming pool 100 in an arcuate manner so as to cross over each other at a center area, much like a domed camping tent. Both outer ends of each support rod 50 are connected to a respective clip assembly 70 which are securely anchored to the upper perimeter edge 105 of the swimming pool 100 by a hook feature 76 (see FIG. 5). The support rods 50 are illustrated here as elongated unitary fiberglass rods which extend the entire diameter of the swimming pool 100; however, it is can be appreciated that the support rods 50 can be made of multiple interlocking sections which form a single support rod assembly providing equal benefit and as such should not be interpreted as a limiting factor of the apparatus 10.

Figure 2C:
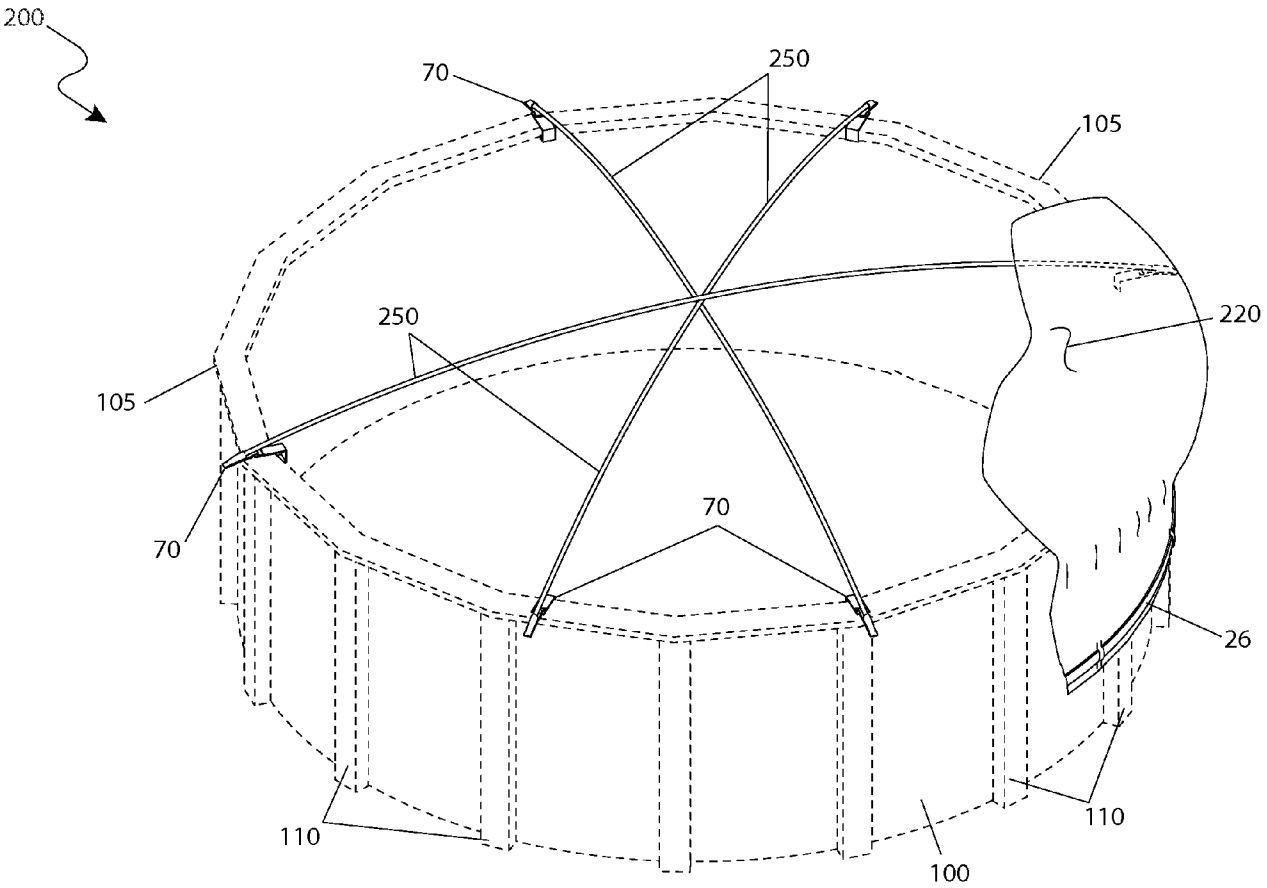
FIG. 2*c* is a top perspective view of a first alternate embodiment of a domed swimming pool cover, according to an alternate embodiment in accordance with the invention.
Figure 2D:
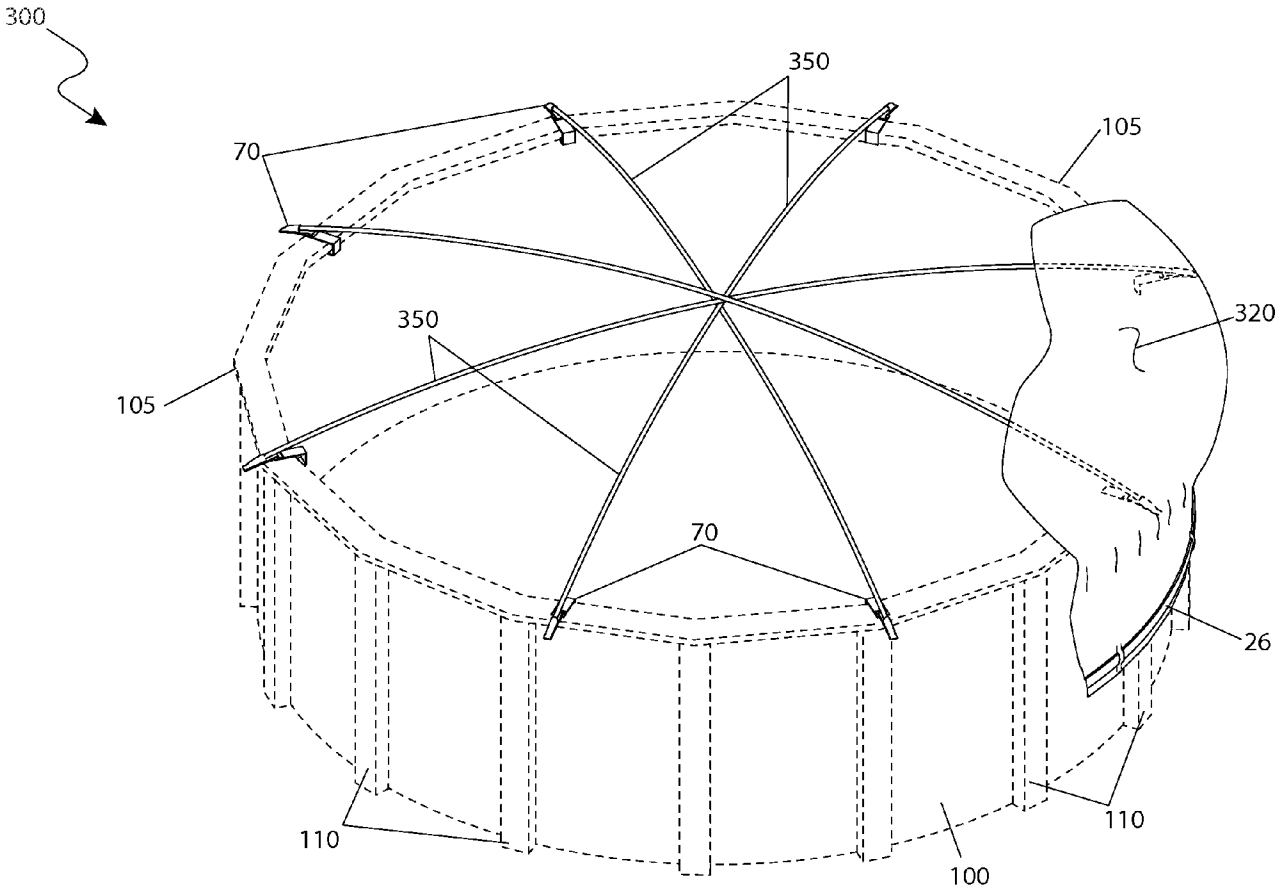
FIG. 2*d* is a top perspective view of a second alternate embodiment of a domed swimming pool cover, according to an alternate embodiment in accordance with the invention.

FIGS. 2*c* and 2*d* show top perspective views of a first alternate embodiment 200 and a second alternate embodiment 300 of the domed swimming pool cover, respectively. The apparatus 10 is depicted here as being sized and configured to compensate for increased loading scenarios. The first alternate embodiment 200 includes a first alternate cover assembly 220 and four (4) first alternate support rods 250 which include an increased diameter or length based upon anticipated additional loading conditions. The first alternate support rods 250 work in conjunction with the first alternate cover assembly 220 (see FIG. 4*b*) in a substantially similar manner as in the preferred embodiment.

The second alternate embodiment 300 includes a second alternate cover assembly 320 and five (5) second alternate support rods 350 which include an increased diameter or length based upon anticipated additional loading conditions. The second alternate support rods 350 work in conjunction with the second alternate cover assembly 320 (see FIG. 4*c*) in a substantially similar manner as in the preferred embodiment.

The first alternate embodiment 200 and second alternate embodiment 300 are sized and configured to compensate for increased loading scenarios based upon various factors such as, but not limited to: the above-ground pool 100 having a greater diameter, greater regional snow loading, and other anticipated loads.

Figure 3:
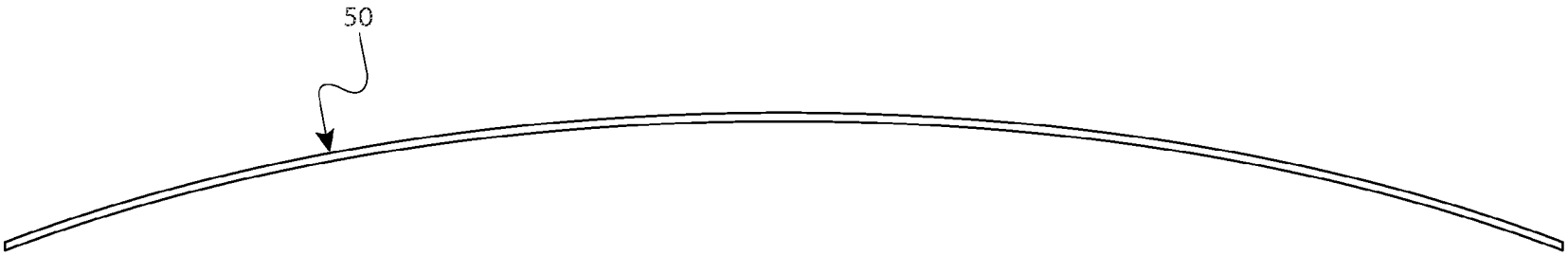
FIG. 3 is a close-up view of a single support rod portion, according to the preferred embodiment.

FIG. 3 shows a close-up view of a single support rod 50. Each support rod 50 includes a generally elongated, cylindrical shaped structure having a round cross-section and preferably made of fiberglass or equivalent material similar to supporting framing members used in camping tent structural frames. Each support rod 50 includes arcuate profile having an end to end linear overall length slightly greater than the diameter of the swimming pool 100. The support rods 50 are arranged at equally-spaced radial positions and attached to the upper perimeter edge 105 of the swimming pool 100 to form a center-elevated crossing pattern. Each support rod 50 is insertingly attached to the cover assembly 20 through a particular one of the plurality of sewn-in sleeves 24 disposed along a bottom surface 23 of the cover assembly 20 (see FIG. 4*a*).

Figure 4A:
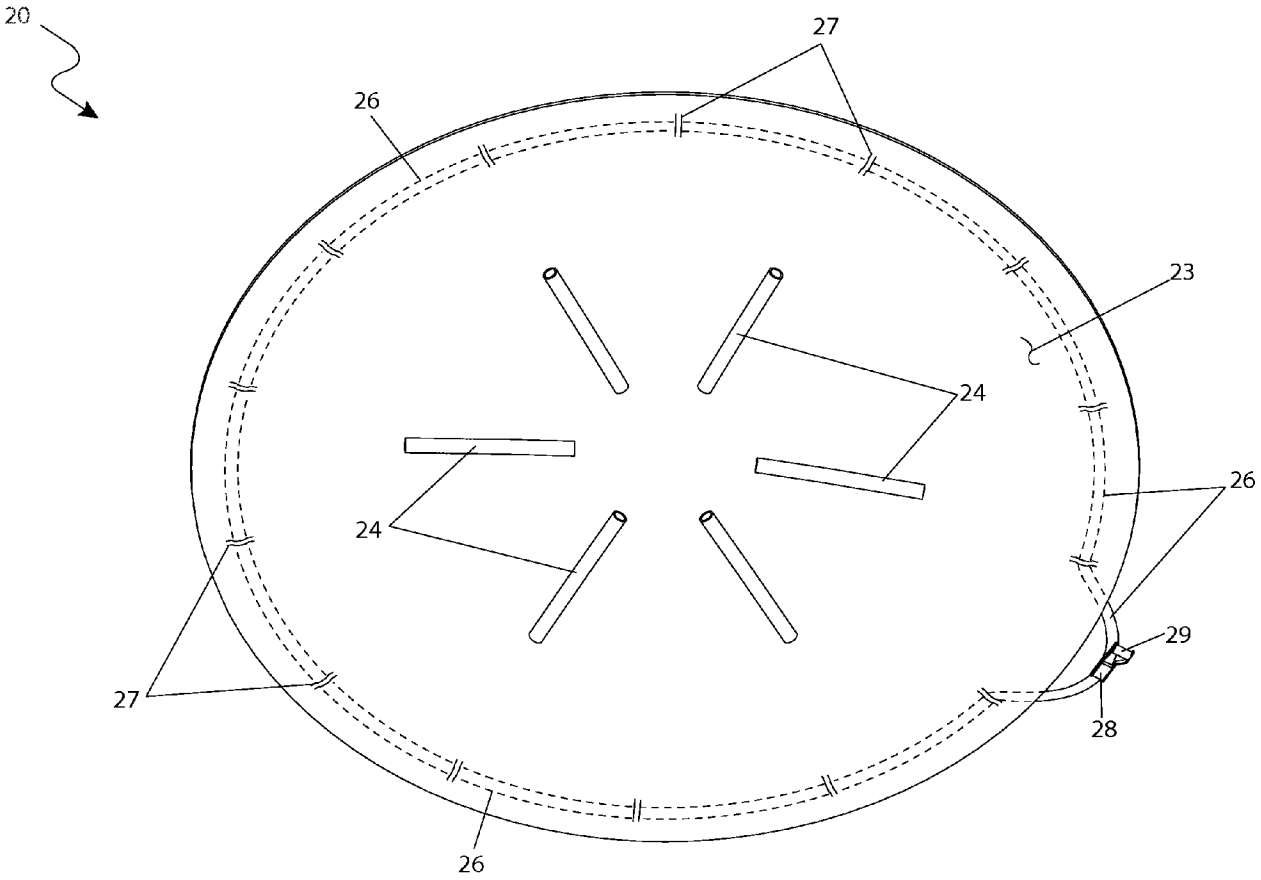
FIG. 4*a* is a bottom view of a cover assembly, according to the preferred embodiment.

FIG. 4*a* shows a bottom view of the cover assembly portion 20. The number and prescribed position of the sleeves 24 corresponds to a number and arrangement of the plurality of support rods 50, as illustrated in the first alternate embodiment 200 and second alternate embodiment 300. The sleeves 24 are integrally sewn to the cover assembly 20. The sleeves 24 are slightly recessed from outer edges and a center region of the cover assembly 20 to allowing the support rods 50 to be inserted into and completely through the sleeves 24 and freely cross over each other at the center region of the cover assembly 20. The sleeves 24 provide for the support rods 50 to be easily inserted into the clip assemblies 70 (see FIG. 1).

Figure 4B:
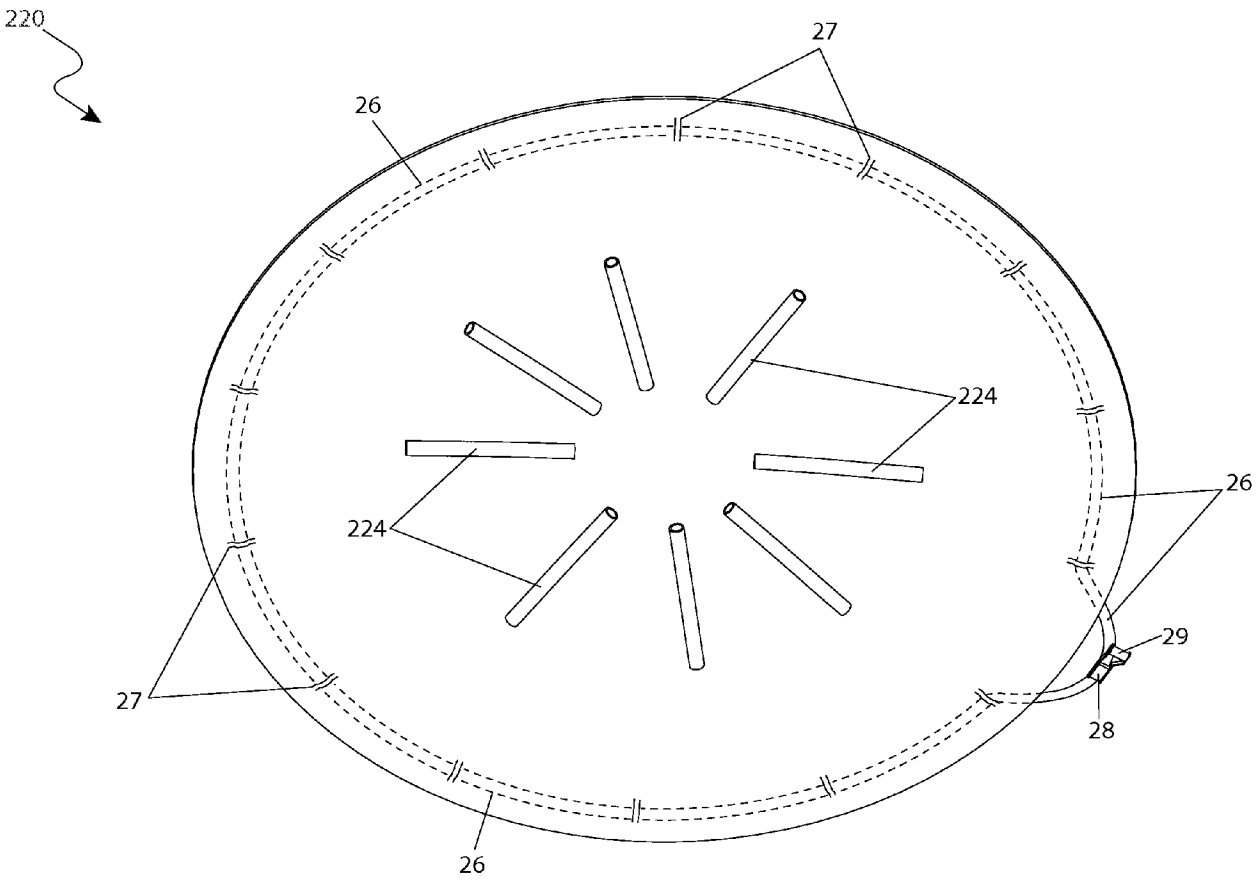
FIG. 4*b* is a bottom view of a first alternate cover assembly of the first alternate embodiment, according to an alternate embodiment.
Figure 4C:
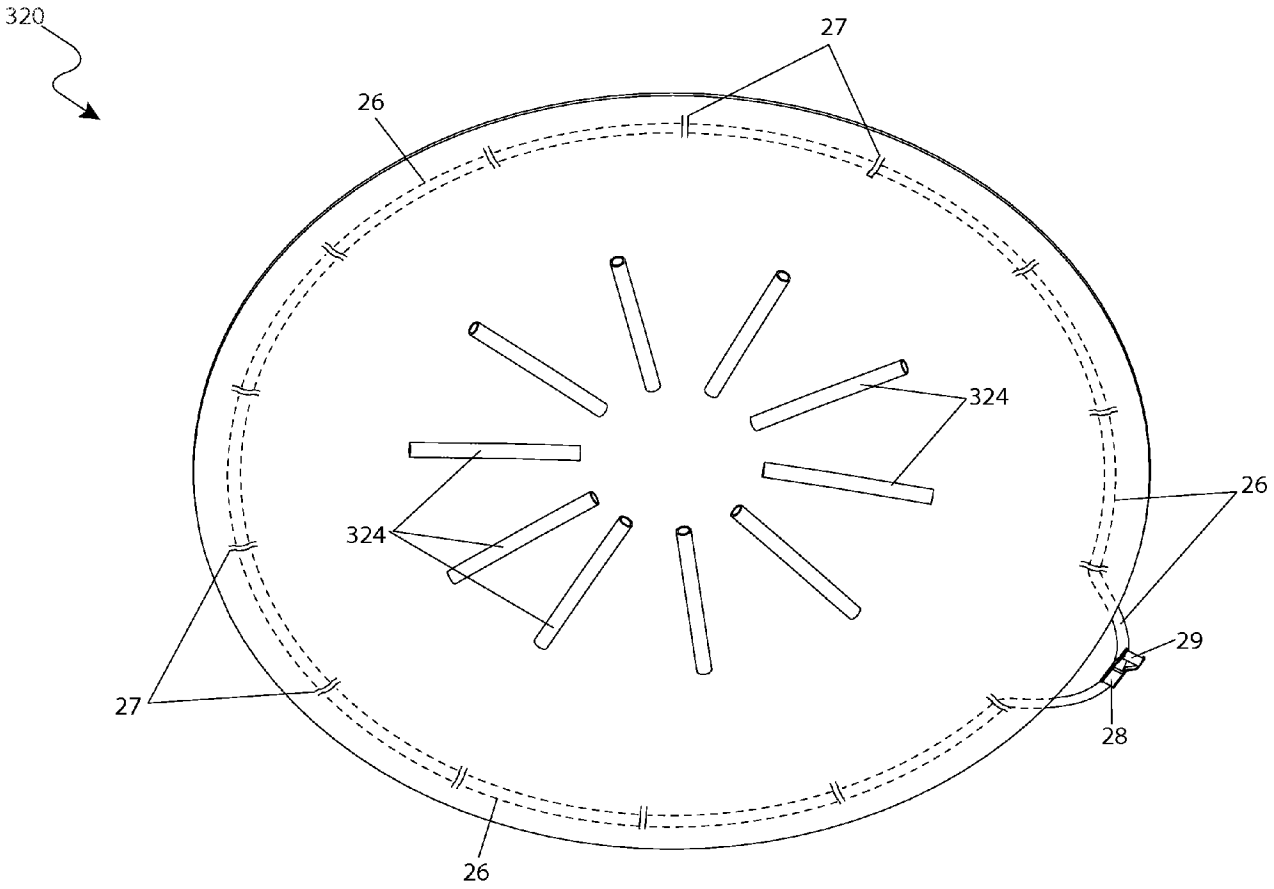
FIG. 4*c* is a bottom view of a second alternate cover assembly of the second alternate embodiment, according to an alternate embodiment.

FIGS. 4*b* and 4*c* show bottom views of the first alternate cover assembly 220 and the second alternate cover assembly 320, respectively. The alternate cover assemblies 220, 320 are specifically sized and configured with a respective plurality of first alternate sleeves 224 and second alternate sleeves 324. The first alternate sleeves 224 and second alternate sleeves 324 are sized and arranged to work in conjunction with the first alternate support rods 250 and second alternate support rods 350, respectively (see FIGS. 2*c*, and 2*d*).

Figure 5:
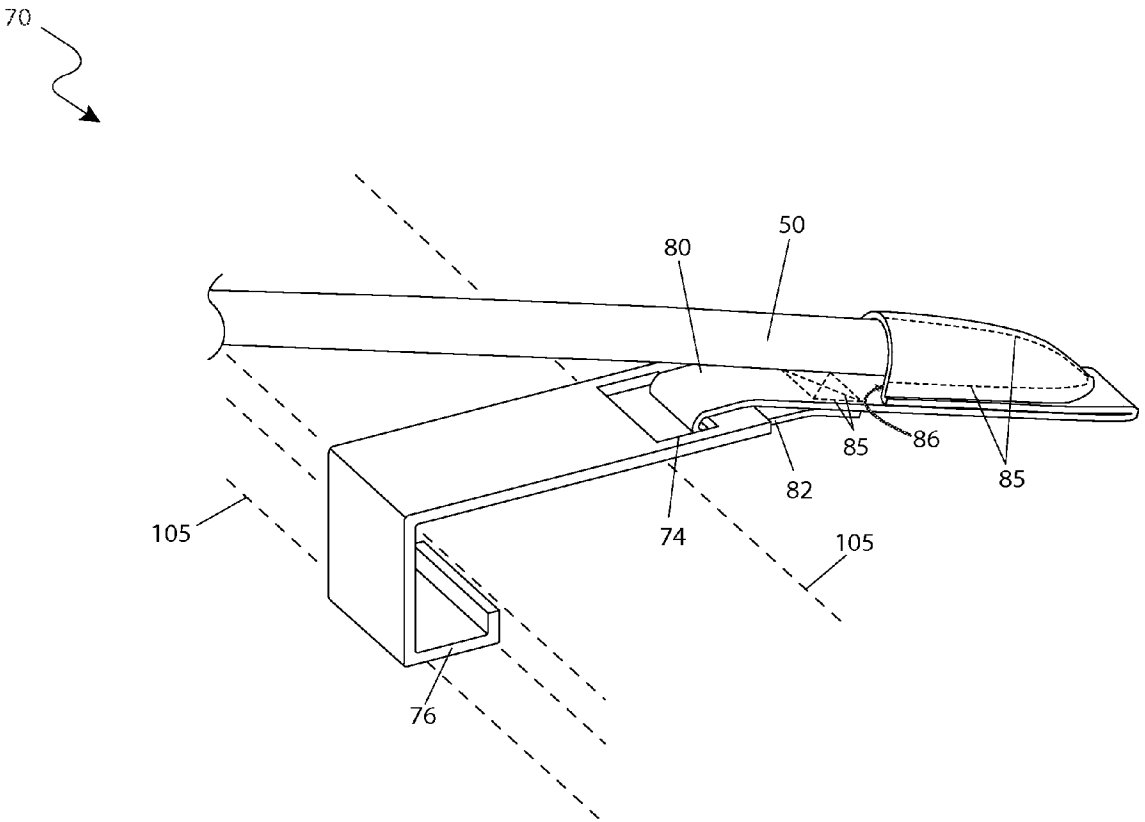
FIG. 5 is a close-up perspective view of a clip assembly, according to the preferred embodiment.

FIG. 5 shows a close-up perspective view of a single clip assembly 70. The apparatus 10 includes a plurality of clip assemblies 70 which insertingly receive opposing ends of each support rod 50. The clip assemblies 70 supportingly attach to the upper perimeter edge 105 of the swimming pool 100. Each clip assembly 70 includes a strong formed metal clip 72 having a generally "U"-shaped hook feature 76 to entrap an inward-facing edge of the upper perimeter edge 105 of the swimming pool 100. The clip 72 includes an oval-shaped aperture 74 along a top surface through which a proximal end of a support rod strap 80 is affixed. The support rod strap 80 is preferably made of nylon strapping material approximately two (2) to three (3) inches in width and one (1) foot in length. The support rod strap 80 is looped through the aperture 74 and stitched 85 securely along a bottom surface, thereby forming a strong looped connection to the clip 72. A distal end of the support rod strap 80 includes an integral pocket 86 formed by folding the distal end of the support rod strap 80 back onto itself and then stitched 85 along side edges to form the pocket 86. Each pocket 86 receives an end portion of the support rod 50 to secure the support rod 50 in an arcuate upwardly domed position (see FIG. 1).

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the apparatus 10, it would be installed as indicated in FIGS. 1 and 2.

The method of installing and utilizing the apparatus 10 can be achieved by performing the following steps: procuring a model of the apparatus 10 which corresponds to a particular swimming pool 100 diameter, having a sufficient number of support rods 50 based upon a regional loading scenario, and having a desired color or pattern; sliding an end portion of each support rod 50 through corresponding aligned pairs of sleeves 24 in order to secure the cover assembly 20 to the support rods 50; pre-positioning the clip assemblies 70 to the upper perimeter edge 105 of the swimming pool 100 in an equally-spaced manner so as to correspond to the respective support rod 50 positions; placing the cover assembly 20, containing the inserted support rods 50, onto the upper perimeter edge 105 of the swimming pool 100 such that the outer end portions of each support rod 50 are aligned with the pre-installed clip assemblies 70; inserting each end portion of the support rods 50 into the pockets 86 of the clip assemblies 70; draping the cover assembly 20 downwardly over side portions of the swimming pool 100; routing the anchor strap 26 through the strap loops 27 of the cover assembly 20, if not previously installed; tightening the anchoring strap 26 swimming pool 100 by actuating the handle 29 of the ratcheting device 28 in a reciprocating manner until tight; and, benefiting from easy assembly and effective removal of rain water and debris from top surfaces of a swimming pool 100 afforded a user of the present apparatus 10.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A domed cover for an above ground swimming pool having a continuous side wall and an upper perimeter edge, said cover comprising:

a plurality of support rods, each support rod of said plurality of support rods comprising an opposing pair of ends;

a plurality of clip assemblies removably connectable to said perimeter edge of said swimming pool, each clip assembly of said plurality of clip assemblies being removably connected to an end of said pair of ends of said support rod, and diametrically opposed pairs of clip assemblies couple said plurality of support rods to said swimming pool; and a cover assembly supportable by said plurality of support rods to cover said plurality of clip assemblies and said swimming pool, further comprising:

a bottom surface; and, a plurality of radial sleeves disposed on said bottom surface, wherein each support rod is insertably receivable by a radially opposed pair of sleeves to couple said cover assembly to said plurality of support rods; and, wherein said plurality of clip assemblies is not connected to said cover assembly.

2. The cover of claim 1, wherein said each support rod of said plurality of support rods further comprises an arcuate profile.

3. The cover of claim 2, wherein a central portion of said each support rod of said plurality of support rods is elevated relative to said opposing pair of ends upon being connected to said diametrically opposed pairs of clip assemblies.

4. The cover of claim 1, wherein said cover assembly further comprises an interior region to cover said swimming pool and a skirt to drape over said side wall of said swimming pool; wherein said skirt extends to a lower edge of said side wall of said swimming pool.

5. The cover of claim 4, further comprising an anchoring strap to secure said cover assembly to said swimming pool, said anchoring strap comprising a length sufficient to wrap circumferentially around said side wall of said swimming pool proximate said lower edge of said swimming pool, wherein said skirt is compressed between said anchoring strap and said side wall.

6. The cover of claim 5, wherein said cover assembly further comprises a plurality of strap loops disposed around a lower portion of said skirt; wherein said anchoring strap is routed through said plurality of strap loops.

7. The cover of claim 6, wherein said anchoring strap is length adjustable.

8. The cover of claim 6, wherein said anchoring strap further comprises a ratcheting device for adjusting to a secured length.

9. The cover of claim 1, wherein each of said clip assemblies further comprises:

a rigid hook to engage said upper perimeter edge of said swimming pool;

a support rod strap affixed to said hook; and, a pocket disposed on an end of said support rod strap opposite said hook to removably receive said end of said support rod.

10. The cover of claim 1, wherein said cover assembly further comprises a durable waterproof textile having shape and dimensions larger than said swimming pool to overlap said upper perimeter edge to prevent debris from entering said swimming pool.

11. The cover of claim 10, wherein said cover assembly further comprises a bottom surface and a plurality of radially oriented sleeves disposed around an intermediate portion of said bottom surface, each sleeve having opposed open ends through which said each support rod is completely insertable.

12. The cover of claim 1, wherein said plurality of support rods comprises three support rods and said plurality of clip assemblies comprises six clip assemblies defining three of said diametrically opposed pairs of clip assemblies; and wherein central portions of said plurality of support rods intersect and are elevated relative to said opposing pairs of ends.

13. The cover of claim 1, wherein said plurality of support rods comprises four support rods and said plurality of clip assemblies comprises eight clip assemblies defining four of said diametrically opposed pairs of clip assemblies; and wherein central portions of said plurality of support rods intersect and are elevated relative to said opposing pairs of ends.

14. The cover of claim 1, wherein said plurality of support rods comprises five support rods and said plurality of clip assemblies comprises ten clip assemblies defining five of said diametrically opposed pairs of clip assemblies; and wherein central portions of said plurality of support rods intersect and are elevated relative to said opposing pairs of ends.

15. A domed cover for an above ground swimming pool having a continuous side wall and an upper perimeter edge, said cover comprising:

a plurality of support rods, each support rod of said plurality of support rods comprising:

an arcuate profile;

an opposing pair of ends; and a length sufficient to span a diameter of said swimming pool;

a plurality of clip assemblies, each clip assembly of said plurality of clip assemblies comprising:

a hook removably connectable to said perimeter edge of said swimming pool;

a support strap comprising a first end affixed to said hook and an opposed second end; and a pocket disposed on said second end of said support strap to removably receive an end of said pair of ends of said each support rod;

a cover assembly comprising:

a bottom surface;

a circular intermediate portion suitably sized to cover said diameter of said swimming pool;

an annular skirt extending from said intermediate portion and suitably sized to cover said side wall extending from said perimeter edge to a lower edge of said side wall;

a plurality of radially oriented sleeves disposed on said bottom surface about said intermediate portion, each sleeve of said plurality of sleeves comprising opposing open ends through which said each support rod is completely insertable; and, an anchoring strap comprising a releasably connectable opposed pair of ends and a length sufficient to wrap circumferentially around said side wall at said lower edge of said side wall to compress said skirt between said anchoring strap and said side wall;

wherein said plurality of clip assemblies is not connected to and is completely separate from said cover assembly.

16. The cover of claim 15, wherein said anchoring strap further comprises a ratcheting device for adjusting to a secured length around said side wall of said swimming pool.

* * * * *